US008181357B2

(12) United States Patent
Moschütz et al.

(10) Patent No.: US 8,181,357 B2
(45) Date of Patent: May 22, 2012

(54) METHOD FOR DRYING SENSITIVE ARTICLES

(75) Inventors: Harald Moschütz, Groβbeeren (DE); Ulrich Nehring, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 802 days.

(21) Appl. No.: 11/887,197

(22) PCT Filed: Feb. 9, 2006

(86) PCT No.: PCT/EP2006/050795

§ 371 (c)(1),
(2), (4) Date: Jan. 12, 2009

(87) PCT Pub. No.: WO2006/114341

PCT Pub. Date: Nov. 2, 2006

(65) Prior Publication Data

US 2009/0211108 A1 Aug. 27, 2009

(30) Foreign Application Priority Data

Apr. 27, 2005 (DE) ..... 10 2005 019 590

(51) Int. Cl.

| | |
|---|---|
| ***F26B 3/00*** | (2006.01) |
| ***F26B 11/02*** | (2006.01) |
| ***F26B 7/00*** | (2006.01) |
| ***F26B 19/00*** | (2006.01) |
| ***F26B 13/10*** | (2006.01) |
| ***F26B 11/18*** | (2006.01) |
| ***F26B 11/22*** | (2006.01) |
| ***F26B 25/18*** | (2006.01) |
| ***F26B 25/10*** | (2006.01) |

(52) U.S. Cl. ..... 34/491; 34/600; 34/442; 34/528; 34/192; 34/237

(58) Field of Classification Search ..... 34/491, 34/88, 108, 600, 442, 528, 572, 192, 194, 34/237, 239; 700/299

See application file for complete search history.

(56) References Cited

U.S. PATENT DOCUMENTS 4,455,653 A 6/1984 Le Gars et al.

(Continued)

FOREIGN PATENT DOCUMENTS

| | | |
|---|---|---|
| DE | 40 34 660 | 5/1992 |
| DE | 197 05 149 | 8/1998 |

(Continued)

OTHER PUBLICATIONS

English Translation of Abstract of Grunert et al., DE 40 34 660 A1, May 1992. (Note: original provided by Applicant in IDS).*

(Continued)

*Primary Examiner* — Kenneth Rinehart
*Assistant Examiner* — Corey J Hall
(74) *Attorney, Agent, or Firm* — James E. Howard; Andre Pallapies

(57) ABSTRACT

A method for drying sensitive articles, essentially textiles made of wool, which are to be dried in the washing drum of a clothes dryer using a computer program. According to known methods for protecting sensitive articles to be dried during a drying program, the articles to be dried are introduced into a protective device which, filled with the articles to be dried, is then inserted into the washing drum before the start of the drying program. In order to prevent damage to the sensitive articles to be dried whenever the protective device is not used, a warning signal is generated prior to the start of the drying program when the protective device containing the sensitive articles to be dried is not properly fixed to the clothes dryer.

7 Claims, 2 Drawing Sheets

U.S. PATENT DOCUMENTS

Figure 4:
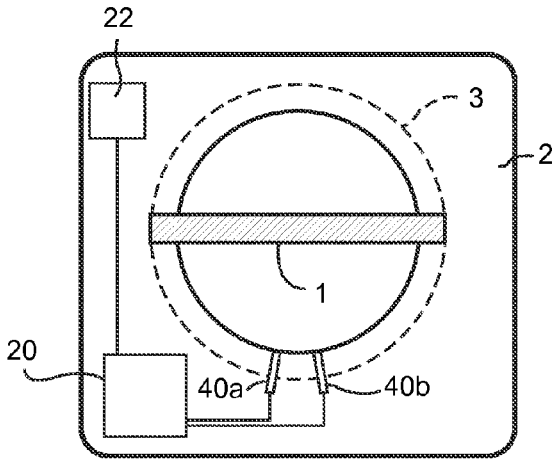

| | | | | |
|---|---|---|---|---|
| 6,026,592 | A | 2/2000 | Herr | |
| 6,915,593 | B2 * | 7/2005 | Gruble et al. | 34/600 |
| 2003/0019253 | A1 | 1/2003 | Lorenz et al. | |
| 2004/0118011 | A1 | 6/2004 | Moschutz et al. | |
| 2006/0150437 | A1 * | 7/2006 | Tarnowski et al. | 34/443 |
| 2007/0119071 | A1 | 5/2007 | Ackermann et al. | |

FOREIGN PATENT DOCUMENTS

| | | | | |
|---|---|---|---|---|
| GB | 2 075 717 | | | 11/1981 |
| JP | 4012799 | A | * | 1/1992 |
| JP | 9-220399 | | | 8/1997 |
| JP | 10156095 | A | * | 6/1998 |
| JP | 10-277292 | | | 10/1998 |
| JP | 2000-84295 | | | 3/2000 |
| WO | WO 2005/040485 | | | 5/2005 |

OTHER PUBLICATIONS

English Translation of Claims of Grunert et al., DE 40 34 660 A1, May 1992.*

English Translation of Disclosure of Grunert et al., DE 40 34 660 A1, May 1992.*

English Translation of Abstract of Ioku et al., JP10-156095A, Jun. 1998.*

English Translation of Disclosure of Ioku et al., JP10-156095A, Jun. 1998.*

English Human Translation of Muramatsu, Tsunehiro, JP 4012799 A, Jan. 1992.*

International Search Report PCT/EP2006/050795.

* cited by examiner

Fig. 1
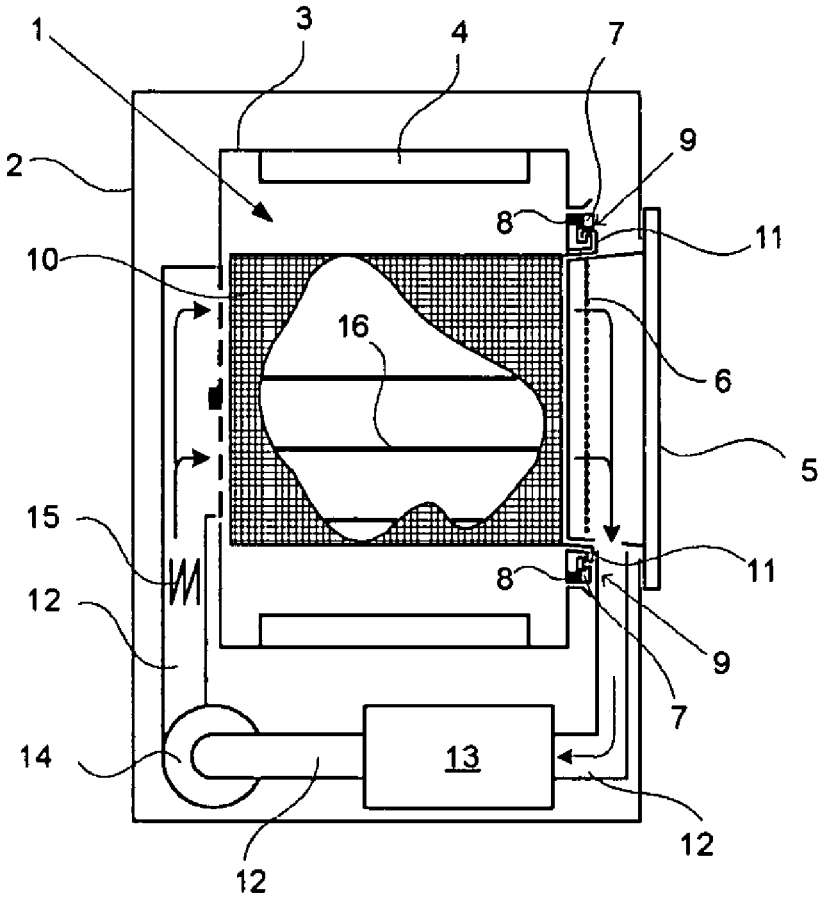
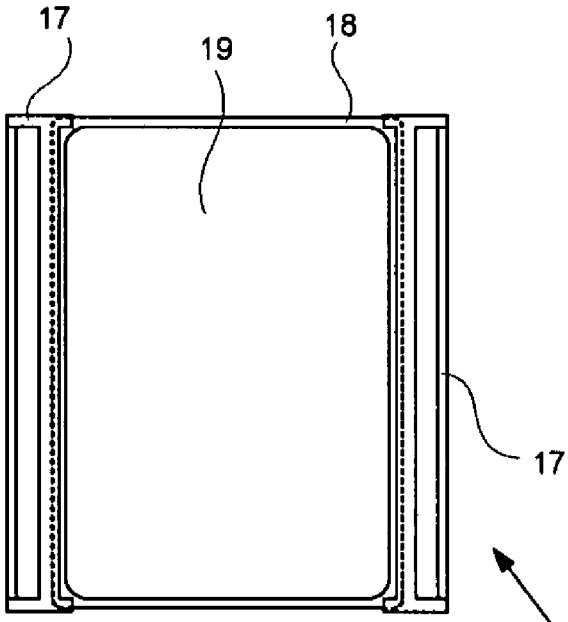
Fig. 2
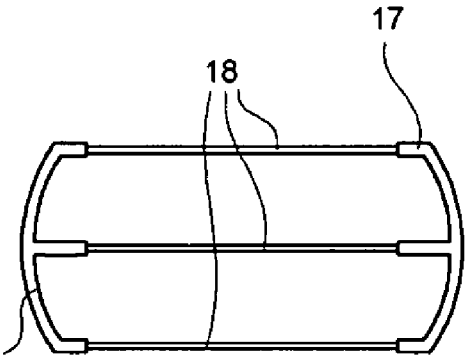
Fig. 3
16

METHOD FOR DRYING SENSITIVE ARTICLES

The invention relates to a method for drying sensitive articles, in particular textiles made of wool, in the laundry drum of a tumble dryer with a control device, comprising the steps: selecting a drying program specifically for drying sensitive articles, introducing the sensitive articles into a protective device and attaching the protective device containing the sensitive articles to the tumble dryer, so that the protective device projects into the laundry drum but does not move in relation to the rotatable laundry drum. The invention also relates to a computer program with program code for a control facility of a tumble dryer and a tumble dryer to implement said method.

Such a method, computer program and tumble dryer can be found in DE 40 34 660 A1.

According to "Patent Abstracts of Japan" re the publication JP 10-277292 A a valve is opened or closed in the process air circuit of a tumble dryer as a function of the presence of a drying support, the presence of which is checked by means of a sensor. According to "Patent Abstracts of Japan" re the publication JP 2000-84295 A a sensor is provided in a tumble dryer, to determine the presence of a filter necessary for the drying process; if the filter is not present, the drying process cannot be carried out.

Methods and devices of the type defined in the introduction are in principle known in the prior art. Thus a protective device in the form of a drying rack for a tumble dryer is known from DE 101 03 987 A1. The drying rack serves to hold sensitive articles during a drying process in a tumble dryer. So that the drying does not move or does not move in relation to the rotating drum during the drying process despite the rotating drum, the drying rack for its part can be inserted in a fixed manner in the drum.

Based on this prior art the object of the invention is to develop a known method for drying sensitive articles and a device and a computer program for implementing said method in such a manner that drying in a manner damaging to the sensitive articles without the use of the protective device is prevented.

This object is achieved by the method in the claims. This method is characterized by the following steps to be carried out by the control device:

Checking whether the protective device is properly attached to the tumble dryer, Checking whether damp drying is present in the laundry drum outside the protective device and Outputting a warning signal, if the drying program for drying sensitive articles is selected but the protective device has not been properly attached to the tumble dryer and not starting or terminating the drying program for drying sensitive articles, if damp drying is identified outside the protective device in the laundry drum.

The term drying generally refers to articles to be dried, in particular textiles. A sensitive article is characterized in that it requires very careful treatment during a drying process, because otherwise there is a risk that the drying may suffer damage, in the form of shrinkage or pilling. To prevent such damage to the drying, careful treatment of the drying can make particular provision for the drying not being moved in relation to the rotating drum of the tumble dryer during the drying process. To ensure this, the sensitive article is clamped or introduced into a drying rack for example, which for its part can be connected in a fixed manner to the laundry drum during the drying process. Using such a drying rack as a protective device has the advantage in particular that no shrinkage occurs when woolen items are the sensitive articles.

Careful treatment of the sensitive articles is also ensured in that a specific drying program, namely a program for drying sensitive articles is optionally set at the tumble dryer.

According to the invention a warning signal is generated for the operator of the tumble dryer, if it is determined after selection or an (attempted) start of the drying program for sensitive articles that a protective device has not been introduced into the laundry drum or the protective device has not been properly inserted. This ensures that the drying program for sensitive articles cannot be activated if the protective device has not been inserted.

According to the invention the method advantageously prevents a drying program, in particular the drying program for drying sensitive articles, running in the tumble dryer, if there is still damp drying loose, in other words outside the protective device, in the laundry drum, even though the protective device is attached to the tumble drier. The selected drying program only runs when this loose drying has been removed from the laundry drum and preferably only the protective device with the sensitive articles contained therein is still present in the drum. As a result a laundry program cannot be started, if drying has been introduced into the drum but the protective device is properly inserted. This serves to protect the drying, since the use of the protective device for drying sensitive articles as enforced by the invention ensures that the drying does not move in relation to the protective device during the drying process but remains clamped in place. This prevents unwanted shrinkage or pilling—knotted fibers which form as the individual fibers move against each other—in the drying. Damage to the drying loose in the drum, in particular due to the resulting rotation of the laundry drum as well as agitation and rubbing of the loose drying against the protective device from the outside, is also advantageously prevented during the drying process.

Checking for or detection of the loose drying outside the protective device in the drum is preferably effected with the aid of two electrodes, which are introduced into the laundry drum in such a manner that they optionally come into contact with the initially still damp drying. An electrical voltage is then applied at the electrodes and the current strength or electrical conductivity between the electrodes is measured. If the measured current strength or electrical conductivity exceeds a respectively predetermined threshold value, this identified exceeding of the threshold value allows it to be concluded that loose, damp drying is present outside the protective device in the laundry drum. In this instance the inventive method advantageously makes provision for the start of the drying program for drying sensitive articles not taking place or the drying program being terminated, in order not to put at risk or damage the sensitive articles loose in the laundry drum.

The above-mentioned object is also achieved by means of a computer program. The advantages of these solutions correspond to the advantages set out above in relation to the claimed method.

Figure 5:
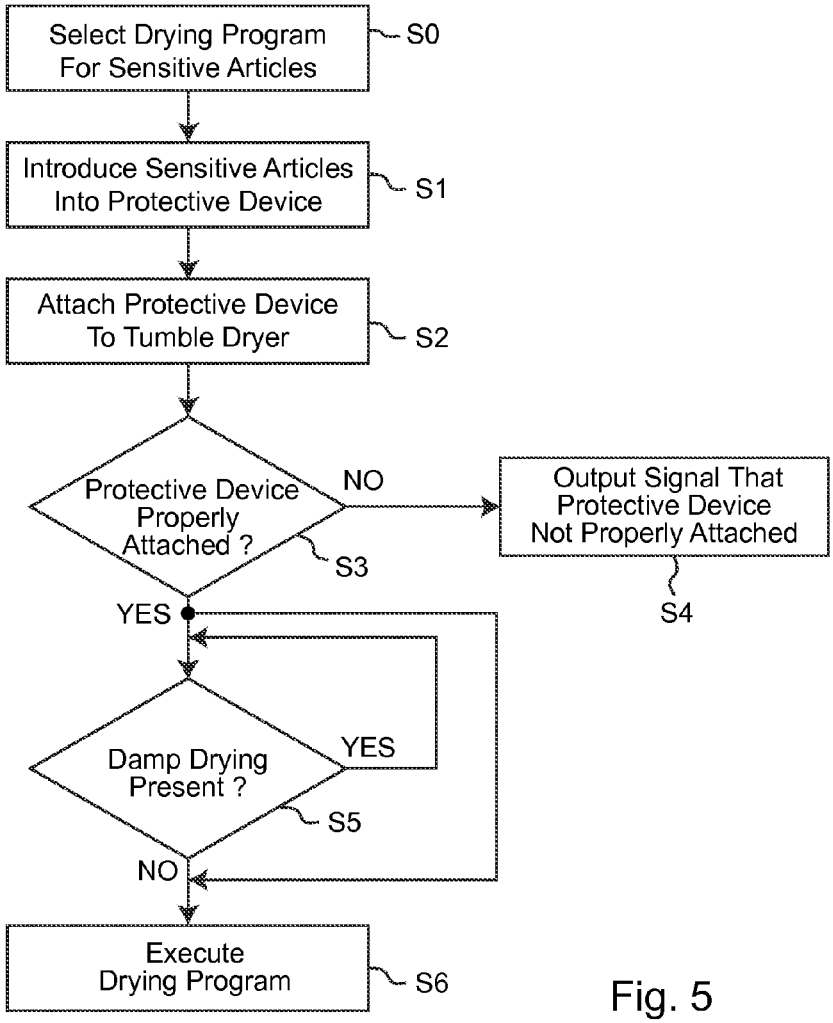

The invention is described in more detail below with reference to exemplary embodiments illustrated in the drawing, in which:

FIG. 1 shows a vertical section through a tumble dryer with the protective device inserted, FIG. 2 shows a top view of the protective device, FIG. 3 shows a front view of the protective device, FIG. 4 shows the tumble dryer according to a second exemplary embodiment of the invention and FIG. 5 shows a flow chart for the inventive method.

The tumble dryer 2 shown in FIG. 1 has a drum 3 that can be rotated about a horizontal axis, within which agitators 4 are fixed, to move laundry during a drum rotation. A fan 14, heating facility 15 and condenser 13 are also provided, to generate an air circuit closed off by an air duct 12 through the drum 3. In this process air heated by the heating facility 15 is directed from the rear through the perforated base of the drum 3 into the drum, comes into contact with the laundry to be dried there and flows through the loading aperture of the drum 3 to a lint filter 6 inside a dryer door 5 closing off the loading aperture. The air stream is then deflected downward in the dryer door 5 and is directed by the air duct 12 to the condenser 13, in which laundry moisture absorbed by the air is condensed by cooling and discharged. After the condenser 13 air is directed by the fan 14 back to the heating facility 15.

The drum 3 is supported at the rear of the base by means of a rotary bearing and at the front by means of a bearing plate 7, with the drum resting by way of a flap on a slide strip 8 on the bearing plate 7 and thus being held at its front end.

A protective device 1 is inserted into the drum 3. This protective device 1 comprises an outer casing 10 and an inner rack 16 disposed within the outer casing 10. The outer casing 10 consists of a cylindrical wire basket, which is closed at a base. At its front open end the outer casing 10 of the protective device 1 has securing plates 11, which can interact with corresponding securing mounts 9, configured within the bearing plate 7.

By securing the protective device 1 solely on the bearing plate 7, the protective device can be disposed in a motionless manner within the rotatable drum 3 with little outlay.

According to the invention the proper arrangement of the protective device 1 on the tumble dryer 2 and in particular on its bearing plate 7 is checked with the aid of a control facility 20. If the drying program specifically for drying sensitive articles is selected but the protective device 1 is not properly attached to the tumble dryer 2, the control facility 20 activates a display facility 22, so that an optical or acoustic warning signal is output at said display facility 22, warning an operator of the tumble dryer that the protective device 1 is not or is not properly attached. At the same time the start of the drying program particularly for sensitive articles is suspended until the protective device 1 is properly attached or inserted. This ensures that said specific drying program is only executed, if the protective device 1 is actually used. The use of the protective device 1 enforced thus according to the invention ensures that the sensitive article does not move during the drying process, thereby preventing shrinkage and pilling in the sensitive articles.

The inner rack 16 shown only partially in FIG. 1 is also shown in FIGS. 2 and 3. The view in FIG. 4 shows two peripheral parts 17, which serve to connect surfaces disposed above one another. The individual surfaces are formed by a plastic frame 18, into which a free, air-permeable plastic net 19 is clamped. This can be done by inserting the plastic net 19 into the form of the frame 18 during the latter's production and injecting it into the frame 18.

The front view of the protective device 1 shown in FIG. 3 shows the securing of the plastic frame 18 in the lateral parts 17. The E-shaped lateral parts 17 have mounts for this purpose, into which the plastic frame can be inserted and optionally latched.

With this refinement only two different parts are advantageously required, on the one hand the lateral parts 17 and on the other hand the surfaces consisting of the frame 18 and plastic net 19.

FIG. 4 shows a schematic diagram of the tumble dryer 2 according to FIG. 1. It again shows the control facility 20 for implementing in particular the drying program for sensitive articles with corresponding selection of said drying program by means of an operating unit (not shown) of the tumble dryer 2. Selection and implementation of said specific drying program result in particularly careful drying, for example using only moderately heated process air to dry the drying.

According to the invention the control device 20 is further configured to carry out a laundry moisture measurement as part of at least some drying programs. To this end electrodes 40*a* and 40*b* for example are attached in the lower region of the laundry drum 3, to which the control facility 20 applies an electrical voltage, in order then to measure the strength of a current flowing between the electrodes or the electrical conductivity between said electrodes. If the measured current strength or conductivity exceeds a respectively predetermined threshold value, it can be concluded that damp drying is present outside the protective device 1 on the base of the laundry drum 3. The determination of the exceeding of one of the predetermined threshold values is then advantageously the trigger for the specific drying program for drying sensitive articles not to be released but to continue to be blocked.

The inventive method is described in more detail below with reference to FIG. 5.

In method step S0 said method provides first for the selection of a drying program specifically for drying sensitive articles. In method step S1, which can take place before or after method step S0 in time, the drying to be dried is introduced into the protective device 1 (shown in FIG. 4 by the shading within the protective device 1). In method step S2 the protective device with the drying located therein is then attached to the tumble dryer 2 in such a manner that the protective device 1 projects into the laundry drum but does not move in relation to the rotatable laundry drum 3. According to the invention it is then checked in method step S3 whether the protective device 1 is properly attached to the tumble dryer 2. This is the case, if, as mentioned, it projects into the laundry drum 3 but does not move in relation to the rotatable laundry drum 3 and preferably latches onto predetermined holders on the tumble dryer 2. The corresponding check is advantageously carried out by the control facility 20 with the aid of suitable sensor facilities (not shown). If in method step S3 the control facility 20 determines that the protective device 1 is not properly attached to the tumble dryer, even though the drying program for drying sensitive articles has already been selected by an operator of the tumble dryer, the control facility 20 first of all does not release said drying program but instead activates a display facility 22, which outputs an optical and/or acoustic signal to indicate that the protective device 1 is not properly attached (method step S4).

If instead the control facility 20 determines that the protective device 1 is properly attached, in principle it releases the preselected drying program for drying sensitive articles for execution (method step S6).

Optionally in a method step S5 before the release of the drying program the control facility 20 can also check whether additional damp drying is present outside the protective device 1 in the laundry drum 3. If this is the case, the check according to method step S5 is advantageously continued, until the damp drying has been removed from the laundry drum 3. Release of the drying program according to method step S6 only takes place when damp drying is no longer present in the laundry drum 3.

The sequence of the described method is preferably controlled by a computer program operating in the control facility 20. This computer program contains program code, which is configured to implement the inventive method. The computer program is typically stored on a data medium. The data medium can be an electronic storage medium, for example a read-only-memory ROM, an optical storage medium, for example a compact disk CD or a magnetic storage medium, for example a diskette. Transmission of the computer program between two locations is however also possible without a data medium, in that the computer program can be transmitted by way of a data line, for example the internet.

The invention claimed is:

1. A method for drying sensitive articles, in a laundry drum of a tumble dryer with a control device, the method comprising the following acts:

selecting a drying program specifically for drying sensitive articles, introducing the sensitive articles into a protective device and attaching the protective device with the sensitive articles located therein to the tumble dryer, so that the protective device projects into the laundry drum but does not move in relation to the rotatable laundry drum, the following acts to be carried out by the control device:

checking whether the protective device is properly attached to the tumble dryer, checking whether damp drying is present in the laundry drum outside the protective device and outputting a warning signal, if the drying program for drying sensitive articles is selected but the protective device has not been properly attached to the tumble dryer and not starting or terminating the drying program for drying sensitive articles, if damp drying is identified outside the protective device in the laundry drum.

2. The method as claimed in claim 1, wherein the check whether damp drying is present outside the protective device in the laundry drum comprises the following acts: introduction of at least two electrodes into the laundry drum; application of an electrical voltage to the two electrodes; measuring the current strength or electrical conductivity between the electrodes when the voltage is applied; and determining that damp drying is present outside the protective device in the laundry drum if the measured current strength or conductivity exceeds a respectively predetermined threshold value.

3. The method as claimed in claim 1, further comprising the control facility starting the drying program for drying sensitive articles when the drying program is selected and the protective device is properly attached to the tumble dryer and also when no additional damp drying is present outside the protective device in the laundry drum.

4. The method according to claim 1, wherein the sensitive articles include textiles made of wool.

5. A computer program control facility product comprising a non-transitory computer readable storage medium having a computer-usable program code stored therein for a control facility of a tumble dryer, wherein the program code contains instructions configured to be executed by a processor of the control facility to implement a method for drying sensitive articles, in a laundry drum of the tumble dryer controlled by the computer program, said method comprising the following acts:

selecting a drying program specifically for drying sensitive articles;

introducing the sensitive articles into a protective device; and attaching the protective device with the sensitive articles located therein to the tumble dryer, so that the protective device projects into the laundry drum but does not move in relation to the rotatable laundry drum;

the control facility checking whether the protective device is properly attached to the tumble dryer;

the control facility checking whether damp drying is present in the laundry drum outside the protective device; and the control facility outputting a warning signal if the drying program for drying sensitive articles is selected but the protective device has not been properly attached to the tumble dryer, the control facility not starting or terminating the drying program for drying sensitive articles if damp drying is identified outside the protective device in the laundry drum.

6. The computer program control facility product of claim 5, wherein the sensitive articles include textiles made of wool.

7. A tumble dryer with a rotatable laundry drum and an operating unit, with which a drying program specifically for drying sensitive articles, which is attached to a protective device for drying sensitive articles that can be attached in the laundry drum, can be selected, a control facility for checking whether the protective device is properly attached to the tumble dryer and a display facility, which is configured, when activated by the control facility, to output an identifiable warning signal, if the drying program specifically for drying sensitive articles is selected but the protective device is not properly attached to the tumble dryer, with the control facility being set up to execute the drying program;

the control facility checking whether the protective device is properly attached to the tumble dryer;

the control facility checking whether damp drying is present in the laundry drum outside the protective device; and the control facility outputting a warning signal, if the drying program for drying sensitive articles is selected but the protective device has not been properly attached to the tumble dryer and not starting or terminating the drying program for drying sensitive articles, if damp drying is identified outside the protective device in the laundry drum.

* * * * *